US009231347B2

(12) United States Patent
Uno

(10) Patent No.: US 9,231,347 B2
(45) Date of Patent: Jan. 5, 2016

(54) CONNECTOR

(71) Applicant: YAZAKI CORPORATION, Minato-ku, Tokyo (JP)

(72) Inventor: Ryosuke Uno, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 58 days.

(21) Appl. No.: 13/948,244

(22) Filed: Jul. 23, 2013

(65) Prior Publication Data

US 2014/0024245 A1 Jan. 23, 2014

(30) Foreign Application Priority Data

Jul. 23, 2012 (JP) ..... 2012-162442

(51) Int. Cl.

| | |
|---|---|
| ***H01R 13/514*** | (2006.01) |
| ***H01R 13/64*** | (2006.01) |
| ***H01R 13/436*** | (2006.01) |
| ***H01R 13/629*** | (2006.01) |
| *H01R 13/422* | (2006.01) |

(52) U.S. Cl.

CPC ..... *H01R 13/64* (2013.01); *H01R 13/4362* (2013.01); *H01R 13/629* (2013.01); *H01R 13/4223* (2013.01)

(58) Field of Classification Search

USPC ..... 439/752, 595

IPC ..... H01R 13/4223,13/4365, 13/4362, 13/4368, H01R 13/4364

See application file for complete search history.

(56) References Cited

U.S. PATENT DOCUMENTS

| | | | | |
|---|---|---|---|---|
| 6,935,904 | B2 * | 8/2005 | Ishiyama | 439/752 |
| 7,182,652 | B2 * | 2/2007 | Yamakado | 439/752 |
| 7,204,726 | B2 * | 4/2007 | Yamashita et al. | 439/752 |
| 7,445,524 | B2 * | 11/2008 | Horiuchi | 439/752 |
| 7,500,887 | B2 * | 3/2009 | Ichio | 439/752 |
| 7,695,315 | B2 * | 4/2010 | Hitchcock et al. | 439/541.5 |
| 2002/0193012 | A1 | 12/2002 | Mase et al. | |
| 2004/0242083 | A1 | 12/2004 | Ishiyama | |

FOREIGN PATENT DOCUMENTS

JP 2003-007389 A 1/2003

OTHER PUBLICATIONS

The Chinese office action letter issued on Apr. 17, 2015 in the counterpart Chinese patent application.

* cited by examiner

*Primary Examiner* — Hien Vu

(74) *Attorney, Agent, or Firm* — Marvin A. Motsenbocker; MOTS Law, PLLC

(57) ABSTRACT

A connector includes: a housing; a plurality of terminal chambers formed in the housing along a longitudinal direction thereof to accommodate terminals therein; a spacer insertion hole formed in the housing along a height direction thereof perpendicular to the longitudinal direction to communicate with the terminal chambers through communication holes and allow an insertion of a spacer for engaging with the terminals, each of the communication holes formed so as to communicate each of the terminal chambers with an outside of the housing, and forming a depression on an underside of each terminal chamber; and a guide protrusion formed about an upstream-side edge of each of the communication holes in an inserting direction of the terminal to lead a front end of the terminal inserted into the terminal chamber toward an upside of a downstream-side edge of each communication hole in the inserting direction.

17 Claims, 4 Drawing Sheets

CONNECTOR

BACKGROUND OF THE INVENTION

1. Field of the Invention

The present invention relates to a connector.

2. Description of the Related Art

Conventionally, there is a known connector including: a housing; cavities, as terminal chambers for accommodating terminals, formed along the longitudinal direction of the housing; and a retainer chambers, as spacer insertion holes, which are formed along the height direction of the housing to communicate with the cavities through communication holes and into which retainers as spacers for engagement with terminals are inserted (see Patent Literature 1 (US 2002/0193012A1)).

In the connector of Patent Literature 1, a lance is arranged in each of the cavities to engage with each of the terminals. In this way, since each of the terminals is doubly engaged in each of the cavities by the lance and the retainer, the connector is adapted so as to prevent each of the terminals from dropping out of the cavity certainly.

SUMMARY OF THE INVENTION

In the connector of Patent Literature 1, the spacer for engagement with the terminal is inserted into the spacer insertion hole and then maintained in a temporary engagement position before the terminal is inserted into the terminal chamber. In this temporary engagement position of the spacer, the communication hole communicating the terminal chamber with the spacer may form a depression on the underside of the terminal chamber.

However, if the depression is produced in the terminal chamber by the communication hole, there is a possibility that when the terminal is inserted into the terminal chamber obliquely, the terminal collides with a downstream-side edge of the communication hole in the inserting direction of the terminal, causing the terminal or the communication hole to be damaged.

Therefore, an object of the present invention is to provide a connector which can prevent the terminal from colliding with an edge of the communication hole opened to the terminal chamber.

A connector according to a first aspect of the present invention includes a housing; a plurality of terminal chambers formed in the housing along a longitudinal direction thereof to accommodate terminals therein; a spacer insertion hole formed in the housing along a height direction thereof perpendicular to the longitudinal direction to communicate with the terminal chambers through communication holes and allow an insertion of a spacer for engaging with the terminals, each of the communication holes formed so as to communicate each of the terminal chambers with an outside of the housing, and forming a depression on an underside of each terminal chamber; and a guide protrusion formed about an upstream-side edge of each of the communication holes in an inserting direction of the terminal to lead a front end of the terminal inserted into the terminal chamber toward an upside of a downstream-side edge of each communication hole in the inserting direction.

With the constitution mentioned above, namely, owing to the provision of the guide protrusion, even if the terminal is inserted into the terminal chamber obliquely, the so-inserted terminal could be led toward the upside of the downstream-side edge opposed to the upstream-side edge through the communication hole.

Accordingly, it is possible to prevent the terminal from colliding with an edge of the communication hole in inserting the terminal into the terminal chamber.

The guide protrusion may be provided, on an upstream side thereof in the inserting direction of the terminal, with an inclined surface having a rising gradient.

With the above constitution, it is possible to lead the front end of the inserted terminal toward a summit of the guide protrusion, allowing the terminal to be led toward the upside of the downstream-side edge stably and smoothly.

With the above constitution, it is possible to reduce the possibility of a collision of the terminal with the downstream-side edge of the communication hole certainly.

DESCRIPTION OF THE EMBODIMENTS

Figure 1:
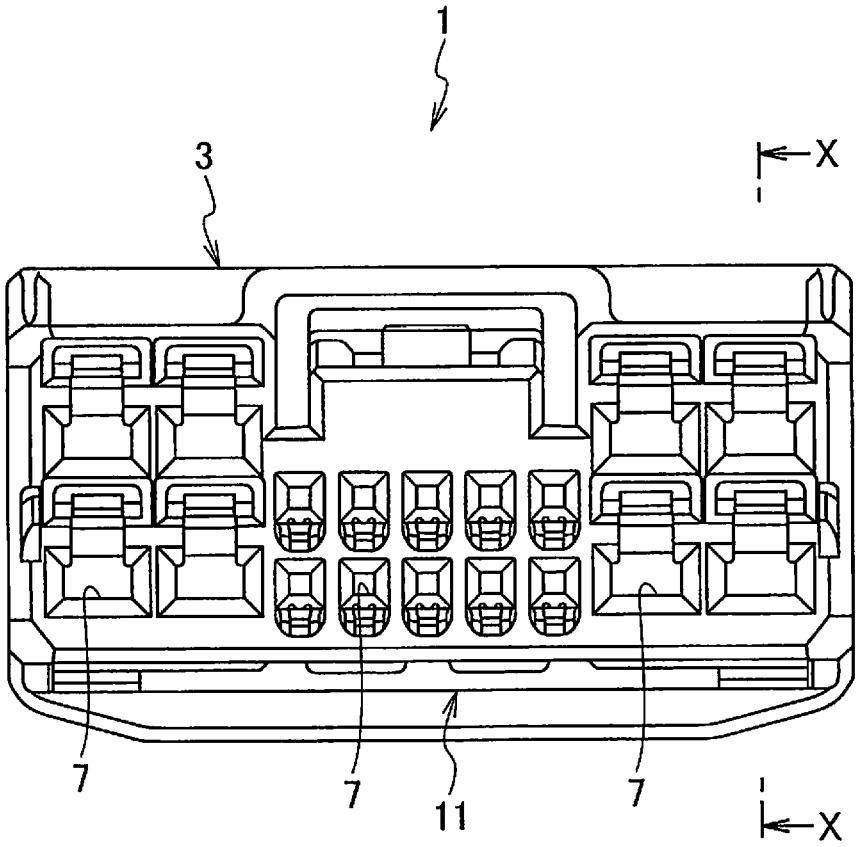
FIG. 1 is a front view of a connector according to one embodiment.
Figure 2:
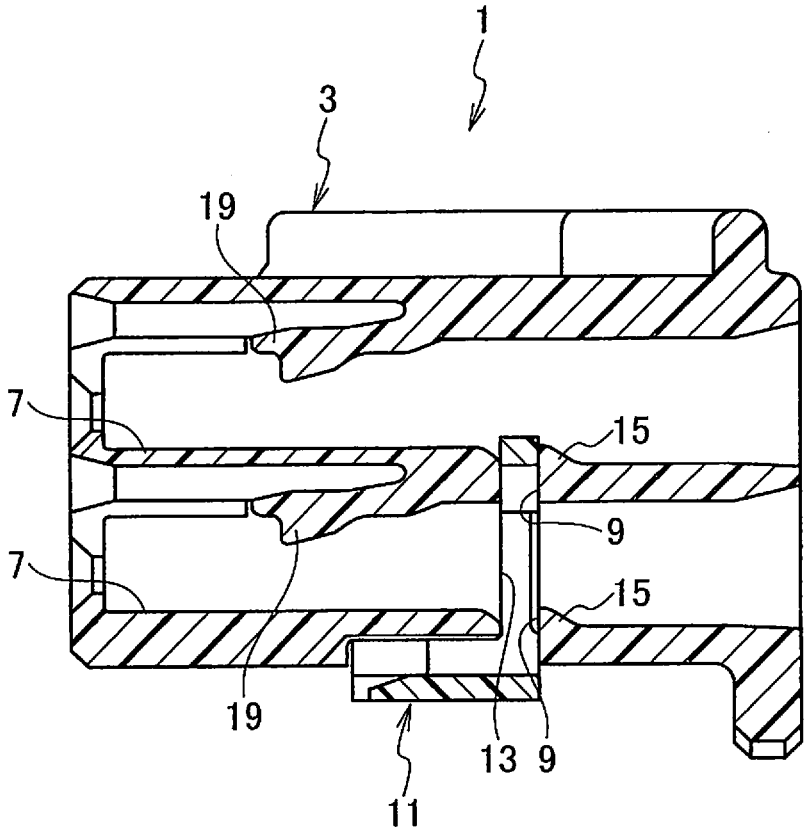
FIG. 2 is a sectional view taken along a line X-X of FIG. 1.
Figure 3:
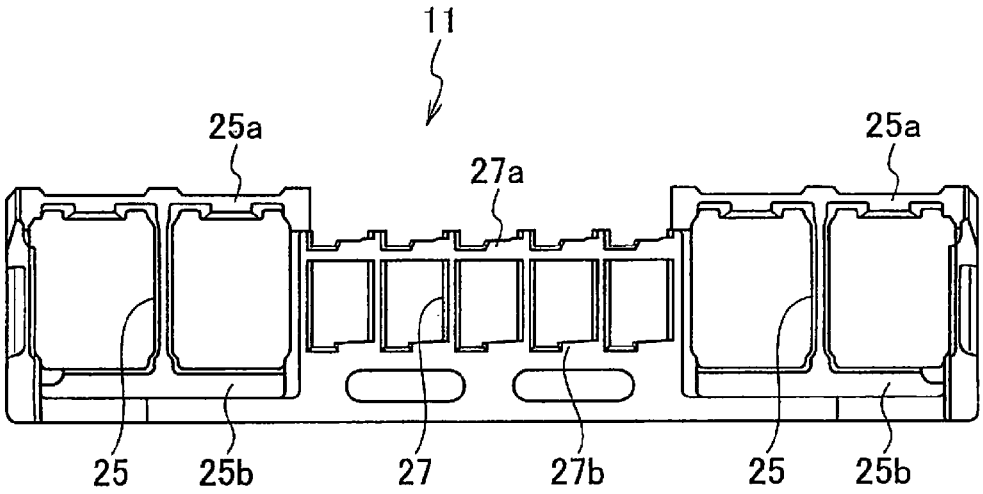
FIG. 3 is a front view of a spacer of the connector according to the embodiment.
Figure 4:
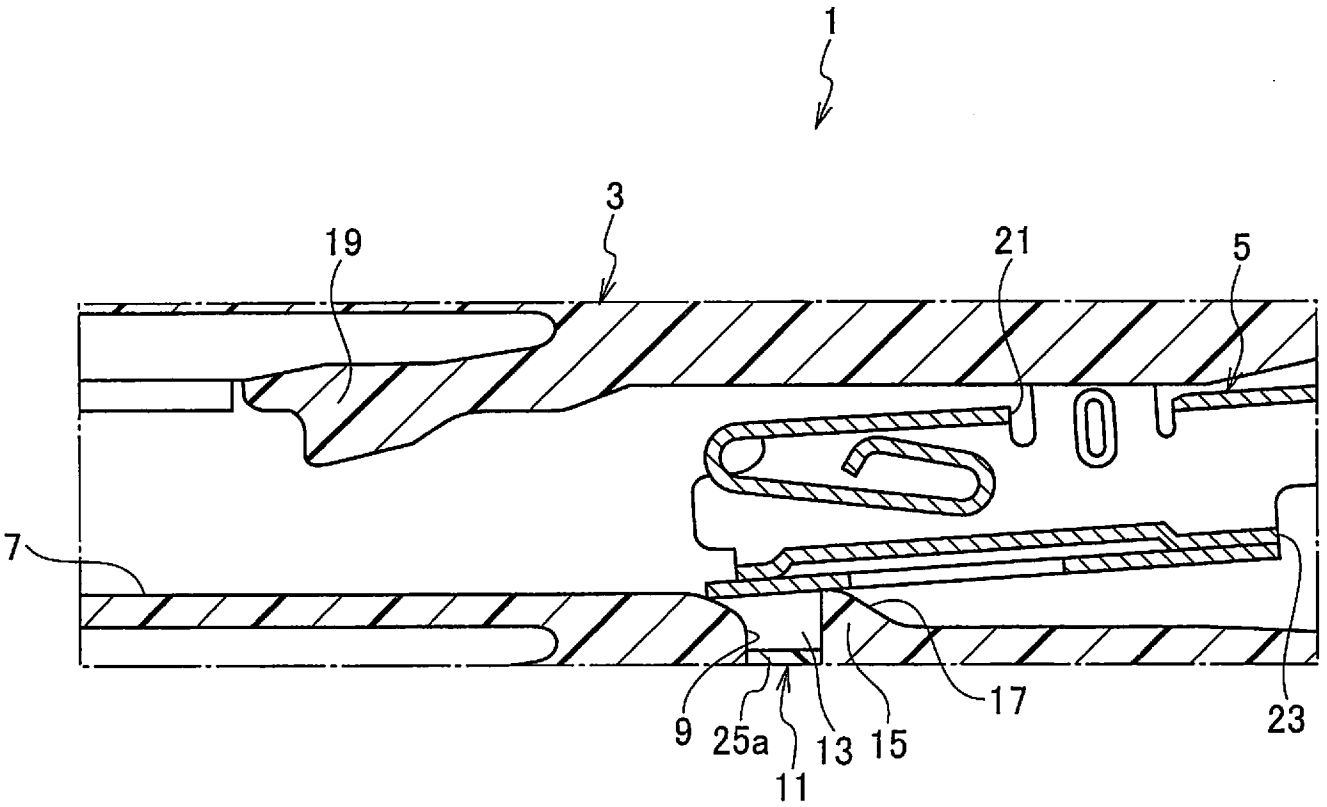
FIG. 4 is an enlarged view of an essential part of the connector according to the embodiment.

A connector according to one embodiment of the present invention will be explained with reference to FIGS. 1 to 4.

The connector 1 according to the embodiment includes a housing 3, and a plurality of terminal chambers 7 and a spacer insertion hole 13 both of which are formed in the housing 3. The terminal chambers 7 are formed along a longitudinal direction of the housing 3 to accommodate terminals 5. The spacer insertion hole 13 is formed along a height direction of the housing 3 to allow a spacer 11 to be inserted into the spacer insertion hole 13. The spacer 11 is formed to be engageable with the terminals 5 when the spacer 11 is inserted into the spacer insertion hole 13. The spacer insertion hole 13 is formed to communicate with the terminal chambers 7 through communication holes 9. An Upper side of the communication hole 9 is formed so as to communicate an upper side, of the terminal chamber 7 with a lower side of the terminal chamber 7. While, a lower side of the communication hole 9 is formed so as to communicate the lower side of the terminal chamber 7 with an outside of the connector 1.

On an upstream side of the communication hole 9 in an inserting direction of the terminal 5 into the terminal chamber 7, a guide protrusion 15 is formed to guide the terminal 5, which is being inserted into the terminal chamber 7, obliquely upward in the inserting direction of the terminal 5.

The guide protrusion 15 is provided with an inclined surface 17, as an ascending slope, on an upstream side of the protrusion 15.

As illustrated in FIGS. 1 to 4, the housing 3 is made from insulating material, such as synthetic resin, and provided in the form of a rectangular solid. The housing 3 is formed with the terminal chambers 7 along the longitudinal direction of the housing 3.

The terminal chambers 7 includes a plurality of large-sized chambers and a plurality of small-sized chambers. The large-sized chambers are stacked in double stages in the height direction of the housing 3. The large-sized chambers are arranged in rows in a width direction of the housing 3. Similarly, the small-sized chambers are also stacked in double stages in the height direction of the housing 3. The small-sized chambers are arranged in rows in the width direction of the housing 3 as well. The terminal chambers 7 are opened on respective one sides in the longitudinal direction of the housing 3, providing respective openings through which the terminals 5 are to be inserted into the chambers 7.

The terminal 5 is made from conductive material, such as metal, and provided in the form of a female terminal having a box-shaped connecting portion. In assembling, the terminal 5 is inserted in the terminal chamber 7 through the opening and then engaged in the chamber 7 since an engagement arm 19 flexible in the terminal chamber 7 is engaged with a first engagement portion 21 formed in the terminal 5, and the spacer 11 inserted into the spacer insertion hole 13 is engaged with a second engagement portion 23 formed in the terminal 5 as well. In this way, the terminal 5 inserted into the terminal chamber 7 is doubly-engaged by the housing 3 and the spacer 11.

The spacer hole 13 is defined so as to penetrate through the housing 3 along the height direction and communicate with the terminal chambers 7 through the communication holes 9. The communication holes 9 are communicated with each other on the undersides of terminal chambers 7, along the width direction of the hosing 3. In assembling, the spacer 11 is inserted into the spacer insertion hole 13 through a lower opening formed on the underside of the housing 3.

The spacer 11 is made from insulating material, such as synthetic resin, and also provided with two kinds of large lattices 25 and small lattices 27 for allowing an insertion of the terminals 5. On the upside and downside of each large lattice 25, an upper engagement protrusion 25*a* and a lower engagement protrusion 25*b* are formed to be respectively engageable with the second engagement protrusion 23 of the terminal 5 on condition that the spacer 11 is arranged in a formal engagement position established in the housing 3. Similarly, on the upside and downside of each small lattice 27, an upper engagement protrusion 27*a* and a lower engagement protrusion 27*b* are formed to be respectively engageable with the second engagement protrusion 23 of the terminal 5 on condition that the spacer 11 is arranged in the formal engagement position established in the housing 3.

In advance of the terminals 5 in the terminal chambers 7 of the housing 3, the spacer 11 is inserted into the spacer insertion hole 13 and then maintained in a temporary engagement position. Under condition that the spacer 11 occupies the temporary engagement position, the terminals 5 are accommodated in the terminal chambers 5. Subsequently, by shifting the spacer 11 from the temporary engagement position to the formal engagement position where the spacer 11 is completely inserted into the spacer insertion hole 13, the terminals 5 can be doubly-engaged with the engagement arms 19 and the spacer 11.

In the temporary engagement position of the spacer 11, the upper engagement protrusions 25*a*, 27*a* (or the lower engagement protrusions 25*b*, 27*b*) are not inserted into the spacer insertion hole 13 completely. Thus, on the underside of each terminal chamber 7, a depression is defined about the corresponding communication hole 9 due to this incomplete insertion of the spacer 11 (see FIG. 4). Under such a situation, if the terminal 5 is inserted into the terminal chamber 7 obliquely, there is a possibility that a front end of the terminal 5 collides with a downstream-side edge of the communication hole 9 in the inserting direction of the terminal 5 conventionally. Therefore, the guide protrusion 15 is provided on the upstream side of the communication hole 9 in the inserting direction of the terminal 5 in order to avoid such a collision.

A protruding height of the guide protrusion 15 is established to be substantially equal to or somewhat higher than the height of the downstream-side edge of the communication hole 9 in the inserting direction of the terminal 5.

When the terminal 5 is inserted into the terminal chamber 7, the guide protrusion 15 operates to lead the front end of the terminal 5 upward of the downstream-side edge of the communication hole 9 in the inserting direction of the terminal 5. Therefore, even if the terminal 5 is inserted into the terminal chamber 7 extremely obliquely, the inclination of the terminal 5 would be suppressed by the guide protrusion 15, enabling an avoidance of the terminal 5 from a collision with the downstream-side edge of the communication hole 9.

The guide protrusion 15 is provided, on the upstream side in the inserting direction of the terminal 5, with the inclined surface 17 having a rising gradient. The inclined surface 17 leads the terminal 5 toward a summit of the guide protrusion 15 when the terminal 5 is inserted into the terminal chamber 7. Thus, even if the terminal 5 is inserted into the terminal chamber 7 obliquely, it is possible to correct the inclination of the terminal 5.

In this way, as the connector 1 has the guide protrusions 15 formed on the upstream side of the communication holes 9 in the inserting direction to lead the inserted terminals 5 to the upside of the downstream-side edges of the communication holes 9, it is possible to lead the inserted terminals 5 to the upside of the downstream-side edges of the communication holes 9 despite that the terminals 5 are inserted into the terminal chambers 7 obliquely.

That is, in the connector 1 constructed above, owing to the protrusions 15, it is possible to prevent the terminals 5 from colliding with the opening edges of the communication holes 9.

Additionally, since the guide protrusions 15 are provided, on the upstream side in the inserting direction of the terminals 5, with the inclined surfaces 17 each having a rising gradient, it is possible to lead the terminals 5, which have been inserted into the terminal chambers 7, toward respective summits of the guide protrusions 15 and also possible to lead the terminals 5 to the upside of the downstream-side edges of the communication holes 9 stably.

Finally, it will be understood by those skilled in the art that the foregoing descriptions are nothing but an embodiment of the disclosed connector and therefore, various changes and modifications may be made within the scope of claims. For example, although each of the guide protrusions 15 is triangular-shaped in the longitudinal cross section of the illustrated connector 1, the guide protrusion and the inclined surface may be provided with any other profiles, for example, a semicircular-shaped guide protrusion, a round-shaped inclined surface and so on.

What is claimed is:

1. A connector comprising:

a housing extending widthwise, lengthwise and height-wise, and defining a housing interior and exterior;

a plurality of terminal chambers into which terminals are pluggable in an insertion direction, the terminal chambers formed extending lengthwise in the housing interior and each of the terminal chambers having an upper side and a lower side in the height-wise direction of the housing and having an upstream side and a downstream side relative to the insertion direction of the terminals into the terminal chambers;

a spacer insertion hole formed extending widthwise across and height-wise into the housing to communicate with the terminal chambers through respective communication holes in each of the terminal chambers, the communication holes communicating the respective upper sides of the terminal chambers with the respective lower sides of the terminal chambers, the communication holes further communicating the respective lower sides of each of the terminal chambers of the housing, the spacer insertion hole allowing the insertion of a spacer for engaging with a respective terminal from the housing exterior; and a guide protrusion formed on an edge of each of the communication holes on the upstream side of the respective terminal chambers, the guide protrusion formed to guide the terminals being plugged into the terminal chambers obliquely upward in the insertion direction to avoid a collision between a front end of each of the terminals and an edge of each of the communication holes opposite with the guide protrusion on the downstream side of the respective terminal chambers;

wherein a protruding height of the guide protrusion is higher than the edge of the communication holes on the downstream side.

2. The connector of claim 1, wherein the guide protrusion is provided with an inclined surface on the upstream side, the inclined surface having a gradient rising in the insertion direction toward a summit of the guide protrusion.

3. The connector of claim 1, wherein each of the guide protrusions comprises a triangular-shape, semicircular-shape, or round-shape in a cross section of the connector in a longitudinal direction.

4. The connector of claim 1, wherein the plurality of terminal chambers includes a plurality of large-sized chambers and a plurality of small-sized chambers.

5. The connector of claim 4, wherein the large-sized chambers are stacked in double stages in the height-wise direction of the housing.

6. The connector of claim 5, wherein the large-sized chambers are arranged in rows in a width direction of the housing.

7. The connector of claim 4, wherein the small-sized chambers are stacked in double stages in the height-wise direction of the housing.

8. The connector of claim 7, wherein the small-sized chambers are arranged in rows in a width direction of the housing.

9. The connector of claim 1, wherein the upstream side of each of the plurality of terminal chambers is provided with respective openings on one side of the housing in a longitudinal direction through which the terminals are to be inserted into the plurality of terminal chambers.

10. The connector of claim 1, wherein each of the terminals is formed from conductive material as a female terminal having a box-shaped connecting portion.

11. The connector of claim 1, wherein each of the plurality of terminal chambers comprises a flexible engagement arm and each of the terminals comprises a first engagement portion and a second engagement portion.

12. The connector of claim 11, wherein each of the terminals is inserted into a respective one of the plurality of terminal chambers and the flexible engagement arm engages with the first engagement portion of the terminal, and wherein the spacer is inserted into the spacer insertion hole and engages with the second engagement portion of the terminal such that the terminal is doubly-engaged by the housing and the spacer.

13. The connector of claim 1, wherein the spacer comprises lattices to allow the insertion of the terminals when the spacer is inserted into the spacer insertion hole.

14. The connector of claim 11, wherein the spacer comprises large lattices and small lattices for allowing insertion of the terminals.

15. The connector of claim 14, wherein each of the large lattices and small lattices comprises an upper engagement protrusion and a lower engagement protrusion to be respectively engageable with the second engagement protrusion of each of the terminals when the spacer is arranged in a formal engagement position in the housing.

16. A method of doubly-engaging terminals in a connector comprising a housing extending widthwise, lengthwise and height-wise, and defining a housing interior and exterior;

a plurality of terminal chambers into which the terminals are pluggable in an insertion direction, the terminal chambers formed extending lengthwise in the housing interior and each of the terminal chambers having an upper side and a lower side in the height-wise direction of the housing and having an upstream side and a downstream side relative to the insertion direction of the terminals into the terminal chambers, wherein each of the terminal chambers is configured with an engagement arm;

a spacer insertion hole formed extending widthwise across and height-wise into the housing to communicate with the terminal chambers through respective communication holes in each of the terminal chambers, the communication holes communicating the respective upper sides of the terminal chambers with the respective lower sides of the terminal chambers, the communication holes further communicating the respective lower sides of each of the terminal chambers of the housing, the space insertion hole allowing the insertion of a spacer for engaging with the terminal from the housing exterior; and a guide protrusion formed on an edge of each of the communication holes on the upstream side of the respective terminal chambers, the guide protrusion formed to guide the terminals being plugged into the terminal chambers obliquely upward in the insertion direction to avoid a collision between a front end of each of the terminals and an edge of each of the communication holes opposite with the guide protrusion on the downstream side of the respective terminal chambers;

wherein a protruding height of the guide protrusion is higher than the edge of the communication holes on the downstream side, the method comprising:

inserting the spacer into the spacer insertion hole in advance of inserting the terminals into the plurality of terminal chambers;

maintaining the spacer in a temporary engagement position;

inserting the terminals into the plurality of terminal chambers such that the terminals are guided by the guide protrusion;

while the terminals are accommodated in the terminal chambers after being guided by the guide protrusion, shifting the spacer from the temporary engagement position to a formal engagement position where the spacer is completely inserted into the spacer insertion hole such that the terminals are doubly-engaged with the engagement arms and the spacer.

17. The method of claim 16, wherein the guide protrusion guides the terminals into the terminal chambers obliquely upward in the insertion direction to avoid a collision between a front end of each of the terminals and an edge of each of the communication holes on the downstream side of the respective terminal chambers when the spacer is in the temporary engagement position and engagement protrusions of the spacer are not completely inserted into the spacer insertion hole.

* * * * *